US008596291B2

(12) United States Patent
Kotefski et al.

(10) Patent No.: US 8,596,291 B2
(45) Date of Patent: Dec. 3, 2013

(54) VENTING LIFTING PLUG FOR MUNITIONS

(76) Inventors: Stojan Kotefski, Bloomingdale, NJ (US); Ductri Nguyen, Parsipanny, NJ (US); Dominick DeMella, Hamburg, NJ (US); Paul Manz, Andover, NJ (US); William Morelli, Spring Lake, NJ (US); Philip J Magnotti, Westfield, NJ (US); Lidija Kotevska, Bloomingdale, NJ (US)

( * ) Notice: Subject to any disclaimer, the term of this patent is extended or adjusted under 35 U.S.C. 154(b) by 0 days.

(21) Appl. No.: 13/443,327

(22) Filed: Apr. 10, 2012

(65) Prior Publication Data

US 2012/0298005 A1 Nov. 29, 2012

Related U.S. Application Data

(63) Continuation-in-part of application No. 13/107,486, filed on May 13, 2011.

(51) Int. Cl.
*F16K 17/14* (2006.01)

(52) U.S. Cl.
USPC ..... 137/72; 220/89.4; 102/481

(58) Field of Classification Search
USPC ..... 137/72, 73, 74; 102/481; 220/89.4
See application file for complete search history.

(56) References Cited

U.S. PATENT DOCUMENTS

| | | | | |
|---|---|---|---|---|
| 195,367 | A * | 9/1877 | Hiiller | 122/504.3 |
| 3,927,791 | A * | 12/1975 | Hershberger | 220/89.4 |
| 2003/0217770 | A1 * | 11/2003 | Schultz et al. | 137/73 |

* cited by examiner

*Primary Examiner* — Kevin Lee
*Assistant Examiner* — Macade Brown

(57) ABSTRACT

A venting lifting plug is provided for an unfuzed munition having a fuze cavity with internal threads, the venting lifting plug is formed of a threaded ring having both internal and external threads together with a lifting plug having a lifting ring, a neck and a round portion having external threads, external threads on the threaded ring being in threaded engagement with internal threads on the fuze cavity of the munition, internal threads on the threaded ring being in threaded engagement with external threads on the lifting plug, and a threaded joint formed between the lifting plug and threaded ring is soldered together with one or more eutectic materials having a melting point lower than a predetermined critical temperature of cook-off gases from the munition.

20 Claims, 4 Drawing Sheets

VENTING LIFTING PLUG FOR MUNITIONS

CROSS REFERENCE TO RELATED APPLICATIONS

This is a continuation-in-part of U.S. patent application Ser. No. 13/107,486, filed May 13, 2011, the entire contents of which are incorporated herein by reference.

STATEMENT OF GOVERNMENT INTEREST

This invention was made in part by employees of the U.S. Army. Accordingly, the U.S. government has certain rights in this invention.

BACKGROUND OF THE INVENTION

1. Field of the Invention

The present invention relates in general to a venting means for munitions such as artillery shells, bombs, rockets, torpedoes, and any other munition which is transported and/or stored without a fusing mechanism. This venting lifting plug comprises a lifting plug with a threaded ring that is eutectically bonded to the lifting plug. In order to maintain the thread engagement capabilities, the threaded rings external threads match the current lifting plugs thread design. In order to attach the threaded ring onto the lifting plug, the lifting plug needs to have its external thread design made smaller to match the threaded rings internal threads. When assembled, lifting plug and threaded ring will have the same external profile as the current lifting plug. Additionally, the threaded joint of the lifting plug and threaded ring will be sealed with a eutectic material. The eutectic seal is to allow the lifting plug portion to remove itself off the threaded ring and vent the cook-off gases from munitions when the energetics reaches a predetermined dangerous temperature. The lifting plug is used as a shipping means to not only lift the munitions but to also protect the munitions from the environment until the fuze is attached. In protecting the munitions until the fuze is attached also has a negative feature, it seals the munitions and its energetics and, under high temperatures, this detonates the munitions as if the fuze was there. This is a dangerous scenario and the proposed innovation allows for the lifting plug to be ejected from munitions to vent the energetics from going high order under these elevated temperatures and thus, the venting lifting plug concept.

2. Description of the Related Art

In general, munitions have operating temperatures between −60° F. to 160° F. In case of a fire, the temperature of the munition raises beyond a safe operating temperature of, for example, 160° F., and the energetics inside the munition phase change from solid to liquid causing an internal "hoop Pressure" that causes the munition to explode in a high order reaction. This reaction is undesired and if the internal hoop pressure could be relieved, the energetics would not undergo high order detonation but instead combustion rather than an explosion.

This phase change phenomena also creates an "hoop" pressure inside the munition that this innovation uses to release the lifting plug from the threaded ring. The "hoop" pressure rises as the temperature increases above the operating temperature of the munition. The lifting plug has a eutectic seal at the threaded joint between the lifting plug and the threaded ring. The eutectic seal is maintained until a specific temperature is reached at which point, the eutectic material phase changes from solid to liquid. At this point, any mechanical features that bond the lifting plug to the threaded ring are nullified, and the lifting plug is free to unthread itself from the threaded ring via the Hoop Pressure forces of the energetics within the munitions and thus not allowing the munition to have a high order reaction. In having the energetic reaction reduced to a combustion rather than a high order reaction allows for fire fighting efforts in what would normally be a hazardous environment. A firefighting capability is most useful for ship board fires as well as in ammunition depot fires.

The United States Department of Defense has mandated that munitions be designed to withstand unplanned stimuli and improve survivability throughout its life cycle. Specifically cookoff or temperatures higher than operating temperatures are one of these unplanned stimuli and the proposed innovation for the lifting plug addresses this issue. The U.S. Army and U.S. Marine Corps field artillery units are equipped with the M109A6 Self Propelled Howitzer, M198, and/or M777A2 Joint Lightweight Towed Howitzers which uses the M795 High Explosive (HE) projectile. This M795 projectile is a typical round that is packaged and transported with a lifting plug and before use, a fuze replaces the lifting plug to make the round ready for its mission. Additionally, there are other projectiles that use the lifting plug as a transport and drop indication means.

The severity of energetic reaction is known to be a function of explosive confinement in thick walled projectiles. In an elevated temperature scenario such as a fire, venting is critical to limit the warhead reaction to burning instead of transitioning to a high order explosion. Accordingly, projectile modifications are desired to incorporate a venting means for the energetics under these non operating temperature exposures. Since the M795 projectile utilizes a lifting plug shown in FIGS. 1A and 1B to seal the shell body and conduct logistical operations, this plug has been modified to permit projectile venting via the addition of a threaded ring and a eutectic seal between the lifting plug and the new threaded ring.

The prior art lifting plug is assembled where the fuze would be normally positioned in a munition. The thread engagement of the lifting plug is identical to the threads used on the fuze, so they are interchangeable.

Several different lifting plug designs have been developed and tested over the years. Venting and drop indicator features have always been a consideration but have not been successful in achieving both characteristics. The proposed innovation herein incorporates the venting and drop indicator features into a new and novel design. Prior art lifting plugs shown in FIGS. 2A and 2B are designed to be able to;

a. Support the weight of the round or pallet during transportation.
b. Deform or break if the round has been dropped with significant energy imparted to potentially cause structural damage to the ogive; thus giving a visual drop indicator.
c. Seal the round fuze cavity during the packaging transportation of the round until the fuze is assembled.

The drop indicator capability is illustrated in FIGS. 2A and 2B.

The current lifting plug has a drop indicator safety feature that cannot be eliminated and/or modified because it is used to identify rounds that have the potential of detonating/"blowing up" within the Cannon Tube due to cracks in the energetic material.

Some lifting plug designs incorporated wax material that would soften at temperatures below the explosive reaction temperature to reduce confinement and prevent transition from deflagration to detonation, such as shown in FIG. 3. A meltable fuze plug demonstrated acceptable results. However, the change to meltable lifting plug has resulted in degradation in the structural integrity of the lifting plug and its ability to accurately indicate excessive force impact to the ogive. This premature lifting plug failure results in a lower projectile availability to the users if projectiles were to experience rough handling in transportation. Additionally, the larger the opening of the vent port being created, the more effective is the elimination of a potential high order reaction. History has proved that the wax material venting methods could not attain a large enough vent opening, and users have abandoned the use of such venting lifting plugs with a drop indicator. The proposed design alternative should give the best of all desired features, namely, a drop indicator and a venting Lifting Plug.

It is therefore an object of the present invention to provide a means for munitions to vent before the temperature and/or internal pressure reaches a high order detonation point ( either temperature or pressure).

It is another object of the present invention to provide a venting means that minimizes and/or eliminates high order detonations of munitions by creating an opening or an orifice in the munition at elevated temperatures.

It is yet another object of the present invention to provide an insensitive munition by providing a device for venting the munitions energetics, whereby to prevent detonation thereof.

It is still another object of the present invention to provide a lifting plug in threaded engagement with the threaded fuze cavity in the munition in which the lifting plug neck portion provides a visual indication of any rough handling which may have caused damage to the munition, and a method and apparatus for venting the munitions energetics which can be used in combination with the lifting plug.

It is another object of the present invention to provide a device for venting the internal pressure produced by the energetic confined within the munitions body which will allow for a pressure buildup as the temperature rises until a specific temperature is reached and, at this point, the eutectic will phase change from solid to liquid and thus allow the lifting plug to be removed from the threaded ring and munition.

It is still another object of the present invention to use the pressure forces created in the munition internal cavity by the temperature rise as the energetic material expands within the cavity and provides the force needed to automatically remove the lifting plug from the munitions when a predetermined temperature is reached.

BRIEF SUMMARY OF THE INVENTION

After considerable investigation and research, applicants developed a means to a insensitive projectile or munition which performs as a normal munition under normal operating temperatures, but under elevated temperatures degrades itself to a combustible rather than a high order reaction. The current munition goes high order under elevated temperatures due to the mechanical seal between the lifting plug and the munition body. Under normal operating temperatures, this is a desired feature, but under higher temperatures this temperature and internal pressure increase cause an undesired detonation of the munition. In order to maintain all of the current safety features (drop indicator), the use of a threaded ring was developed so that all of the current lifting plug properties were maintained and a venting feature could be added to the lifting plug.

The threaded ring has an external and internal thread which make engagement with the external thread on a lifting plug and internal threads on the munition. The munitions threads are adapted to receive a threaded fuze for operational use and a lifting plug for packaging and transport use. To prevent the release of cook-off gases and energetic material created from the expansion of munitions energetics as the temperature is increased, but before a predetermined critical temperature is reached, the joint between the lifting plug and the threaded ring is soldered with a eutectic solder. The eutectic solder melts at a predetermined temperature and allows the lifting plug to be ejected from the munition. The removal of the lifting plug from the munition eliminates pressure buildups within the munition cavity and thus a high order reaction cannot occur. This method of venting the lifting plug retains all of the mechanical properties under normal operating temperatures, but degrades the munition under predetermined elevated temperatures.

In a first preferred embodiment there is provided in an unfuzed munition having a threaded fuze cavity adapted to receive a threaded fuze or a venting lifting plug with an improvement comprising of:

- a threaded ring connected to a neck portion of the lifting plug which in turn is connected to a threaded fuze cavity in the munition,
- a threaded ring being threaded both externally and internally, and being adapted to engage internal threads on said threaded fuze cavity, and the internal threads on the threaded ring being adapted for engagement with external threads on the lifting plug, when assembled on a lifting plug the threaded ring has its internal threads soldered with a eutectic at the threaded joint with the lifting plug.

In a second preferred embodiment there is provided in connection with the first preferred embodiment an unfuzed munition wherein external threads are provided on the lifting plug and internal threads on the threaded ring have a pitch which facilitates rotation of the lifting plug when cook-off temperatures have risen high enough to melt the eutectic solder and pressure build-up of cook-off is sufficiently high to cause rotation and separation of the lifting plug.

In a third preferred embodiment there is provided in connection with the first preferred embodiment an unfuzed munition wherein the threaded ring is formed of carbon steel or a material stronger than the base material of the lifting plug.

In a fourth preferred embodiment there is provided in connection with the first preferred embodiment an unfuzed munition wherein the eutectic wets the threaded surfaces of the lifting plug and the threaded ring.

In a fifth preferred embodiment there is provided in connection with the first preferred embodiment an unfuzed munition wherein a lifting plug is in threaded engagement with a threaded ring which in turn is in threaded engagement with a fuze cavity of a munition.

In a sixth preferred embodiment there is provided in connection with a fifth preferred embodiment an unfuzed munition wherein the threaded joint between the lifting plug and the threaded ring is soldered with a eutectic which wets both threads in the threaded joint.

In a seventh preferred embodiment there is provided in connection with the sixth preferred embodiment an unfuzed munition wherein the eutectic solder is used to provide a pressure and mechanical seal between the lifting plug and the threaded ring joint.

In an eighth preferred embodiment there is provided in connection with the seventh preferred embodiment an unfuzed munition wherein the eutectic solder seals the threaded joint and prevents release of cook-off gases and energetic materials until a predetermined temperature is reached.

In a ninth preferred embodiment there is provided in connection with the first preferred embodiment an unfuzed munition wherein internal threads on the treaded ring and external threads on the lifting plug are coated with a copper or tin coating to facilitate wetting of the threaded joint by the eutectic.

In a tenth preferred embodiment there is provided in connection with the first preferred embodiment an unfuzed munition, wherein there is a sufficient clearance between the internal threads on the threaded ring and the external threads of the lifting plug to facilitate flow of eutectic into the threaded joint when these threads are in locking and sealing engagement.

In an eleventh preferred embodiment there is provided in connection with the first preferred embodiment an unfuzed munition wherein the threaded ring is formed from a material stronger than the material from which the neck of the lifting plug is formed whereby to maintain the damage indicator feature of the lifting plug neck.

In a twelfth preferred embodiment there is provided a venting discharge means or venting lifting plug for an unfuzed munition having a fuze cavity with internal threads, said venting lifting plug comprising: a threaded ring having both external and internal threads, together with a lifting plug having a neck portion which in turn is connected to a round portion having external threads, said external threads on the threaded ring adapted for threaded engagement with internal threads on the fuze cavity, internal threads on the threaded ring adapted for threaded engagement with external threads on the lifting plug, a joint formed between threads on the threaded ring and threads on the lifting plug, said joint being soldered together with one or more eutectic materials having a melting point below a predetermined critical temperature and pressure of cook-off gases generated by the munition.

In a thirteenth preferred embodiment there is provided in connection with the twelfth preferred embodiment a venting lifting plug wherein external threads on the lifting plug and internal threads on the threaded ring have a pitch which facilitates rotation of the lifting plug when cook-off temperatures have risen high enough to melt the eutectic solder and pressure build-up of cook-off gases is sufficiently high to cause rotation and separation of the lifting plug from the munition.

In a fourteenth preferred embodiment there is provided in connection with the twelfth preferred embodiment a venting lifting plug wherein the threaded ring is formed of carbon steel, stainless steel, titanium, or other strong alloys that are stronger than the material of the lifting plug to maintain the dent indicator feature.

In a fifteenth preferred embodiment there is provided in connection with the twelfth preferred embodiment a venting lifting plug wherein the eutectic wets threaded surfaces of both the lifting plug and threaded ring.

In a sixteenth preferred embodiment there is provided in connection with the fifteenth preferred embodiment a venting lifting plug wherein a threaded joint between the lifting plug and the threaded ring is soldered with one or more eutectic materials which wet both threads of the joint.

In a seventeenth preferred embodiment there is provided in connection with the twelfth preferred embodiment a venting lifting plug wherein the eutectic material is selected from the group consisting of bismuth, tin and/or lead, or other combination thereof to achieve a eutectic at the desired temperature.

In an eighteenth preferred embodiment there is provided in connection with the seventeenth preferred embodiment a venting lifting plug wherein eutectic solder seals the threaded joint and prevents release of cook-off gases and energetic pressures until a predetermined temperature is reached, and internal threads on the threaded ring and external threads on the lifting plug are coated with a eutectic material with a phase change temperature below the detonation temperature of the energetic materials, said eutectic materials including alloys of bismuth, lead and tin.

In a nineteenth preferred embodiment there is provided in connection with the twelfth preferred embodiment a venting lifting plug wherein there is a sufficient clearance between internal threads on the threaded ring and the external threads on the lifting plug to facilitate flow of eutectic material into the threaded joint when these threads are in locking and sealing engagement, and the threaded ring is formed from a material stronger than the material from which the neck of the lifting plug is formed, whereby to maintain a damage indicator of the lifting plug neck.

In a twentieth preferred embodiment there is provided a venting lifting plug for an unfuzed munition having a fuze cavity with internal threads, said venting lifting plug cooperating with a threaded ring having both external and internal threads, said lifting plug having a neck portion which in turn is connected to a round portion having external threads, said external threads on the threaded ring adapted for threaded engagement with internal threads on the fuze cavity, internal threads on the threaded ring adapted for threaded engagement with external threads on the lifting plug, a joint being formed between threads on the threaded ring and threads on the lifting plug, said joint being soldered together with one or more eutectic materials having a melting point below a predetermined critical cook-off temperature and pressure generated by the energetics of the munition, the external threads on the lifting plug and internal threads on the threaded ring have a pitch which facilitates rotation of the lifting plug when cook-off temperatures have risen high enough to melt the eutectic solder and pressure build-up of the munition energetic is sufficiently high to cause rotation and separation of the lifting plug from the munition, the threaded ring being formed of carbon steel; stainless steel, titanium, tool steel or other strong alloys, and the eutectic wetting threaded surfaces of both the lifting plug and threaded ring.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Munitions are transported and stored without a fuze which can be secured to the munition before use. These munitions have a threaded fuze cavity (not shown) into which can be inserted a lifting plug shown generally at 37 in FIGS. 1A and 1B. Lifting plug 37 comprises lifting ring 39 connected to neck 41 and threaded round portion 43.

Figure 2A:
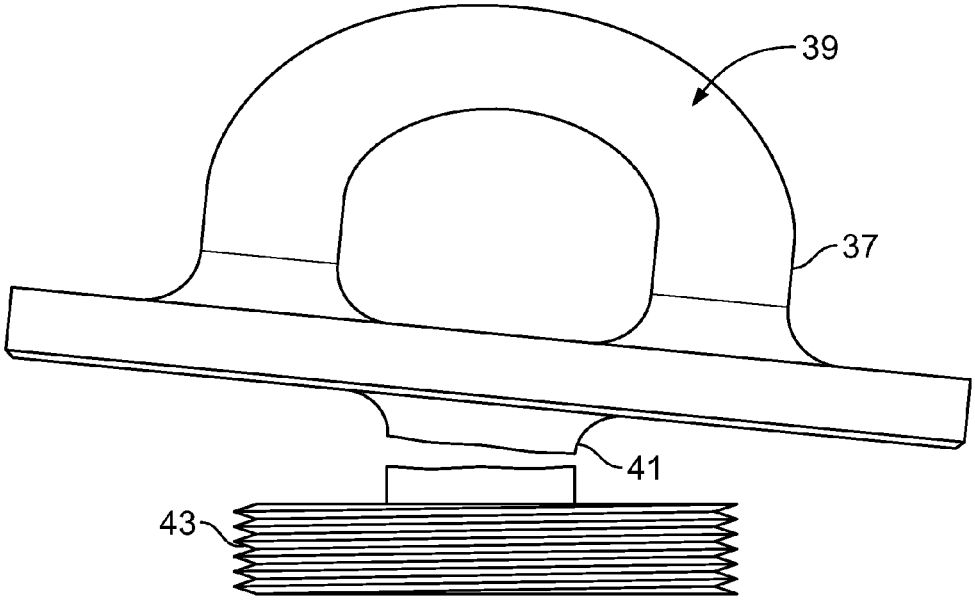
FIG. 2A is a side view of a conventional lifting plug with a broken neck portion which is designed to break or deform when subjected to excessive loads, so as to provide a visual indication of possible damage to the munition.
Figure 2B:
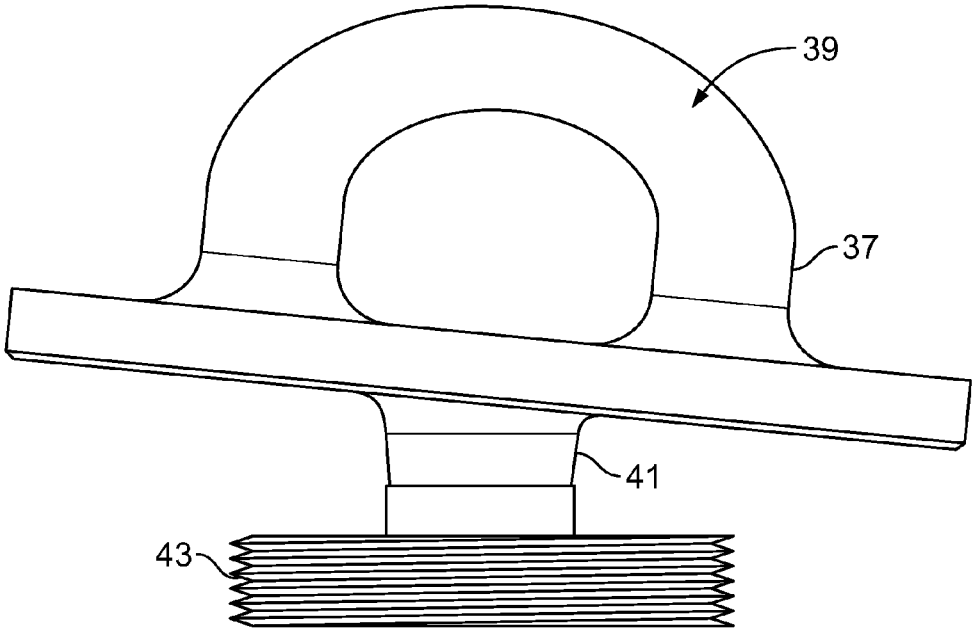
FIG. 2B is a side view of a conventional lifting plug with a bent neck portion which has been designed to deform when subjected to excessive loads, thus providing a visual indication of possible damage to the munition.

The neck 41 was formed of a frangible or weakened material which is designed to either rupture the neck 41 as shown in FIG. 2A or deform the neck 41 as shown in FIG. 2B when the munition is subjected to rough handling which might damage the munition itself and create an unsafe and/or unstable munition.

Figure 1A:
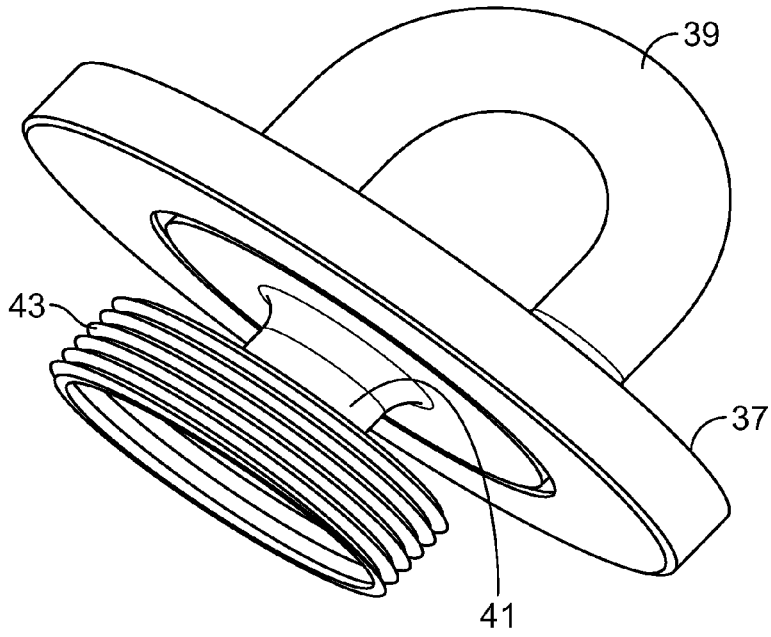
FIG. 1A is a perspective view of a conventional lifting plug adapted to be in threaded engagement with a threaded fuse cavity on an unfused munition, illustrating in particular the threaded portion of the lifting plug.
Figure 1B:
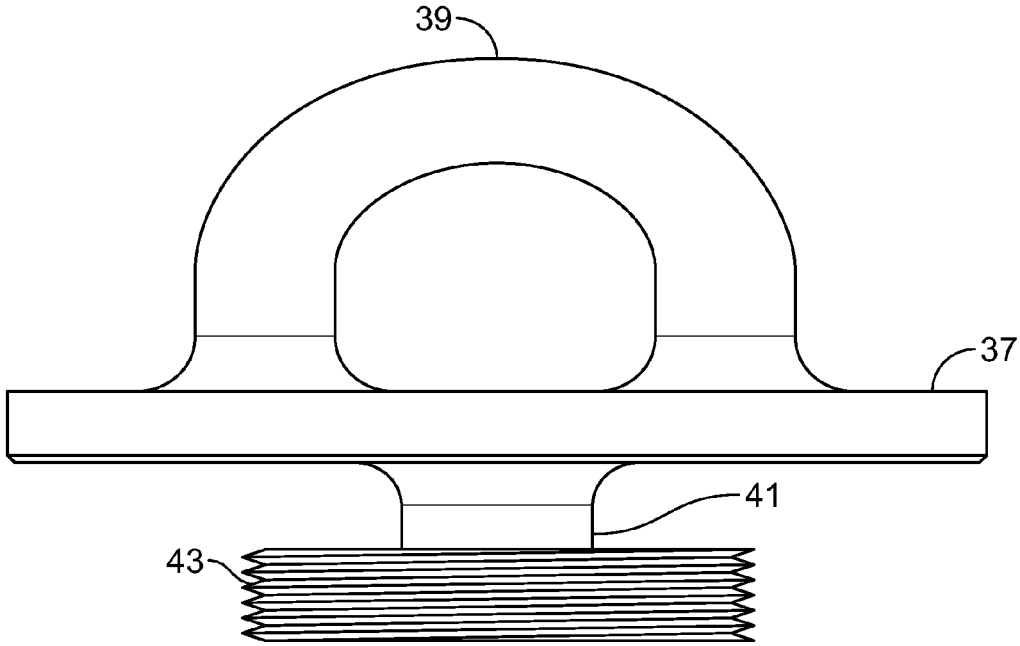
FIG. 1B is a side view of a conventional lifting plug, also illustrating the neck portion connecting the threaded portion of the lifting plug.
Figure 3:
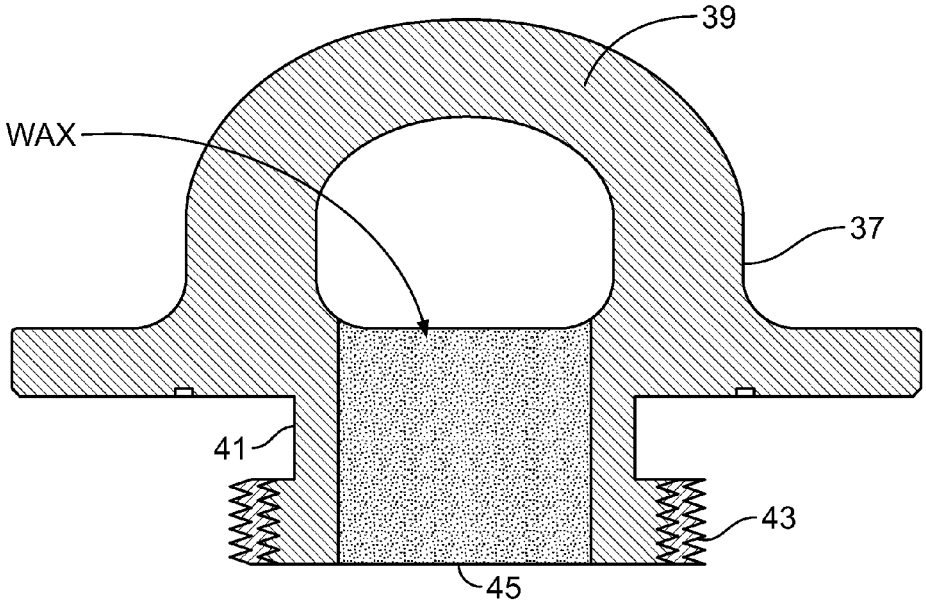
FIG. 3 is a side view of a conventional lifting plug illustrating particularly a round cavity in the center of the plug which is filled with wax designed to melt and vent high temperature cook-off gases and energetics from the munition.
Figure 4:
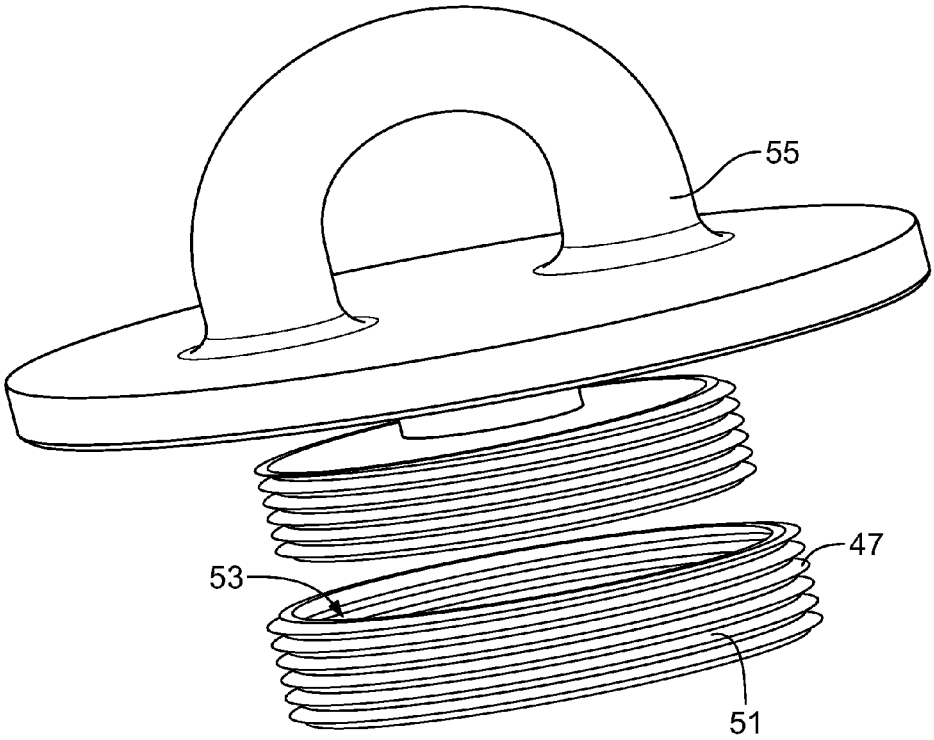
FIG. 4 is a perspective exploded view of a lifting plug of the present invention which can be used in combination with a threaded ring designed to be in threaded engagement with both the lifting plug and threaded cavity on the munition.

Lifting plug 37 was modified to include a venting method using a wax material (FIG. 3). This lifting plug with a wax material was found to be ineffective since it interfered with the visual indicator provided by weakened neck 41 as illustrated in FIGS. 1A and 1B. FIG. 4 shows the threaded ring 47 of the present invention which facilitates venting of hot cook-off gases from the munition and rotation and separation of the lifting plug from a munition.

Threaded ring 47 is added to the current lifting plug design as shown in FIG. 4. Threaded ring 47 can be fabricated from a material stronger than the current lifting plug material (cast carbon steel) such that it is not weaker than the current design. This feature retains the current lifting plug's ability to indicate damage transparent to the new design. Additionally, the threaded ring 47 allows for the load bearing capability to be maintained as in the current design. Threaded ring 47 serves as the innovation for adding insensitive munition features to the current lifting plug 37.

Figure 5:
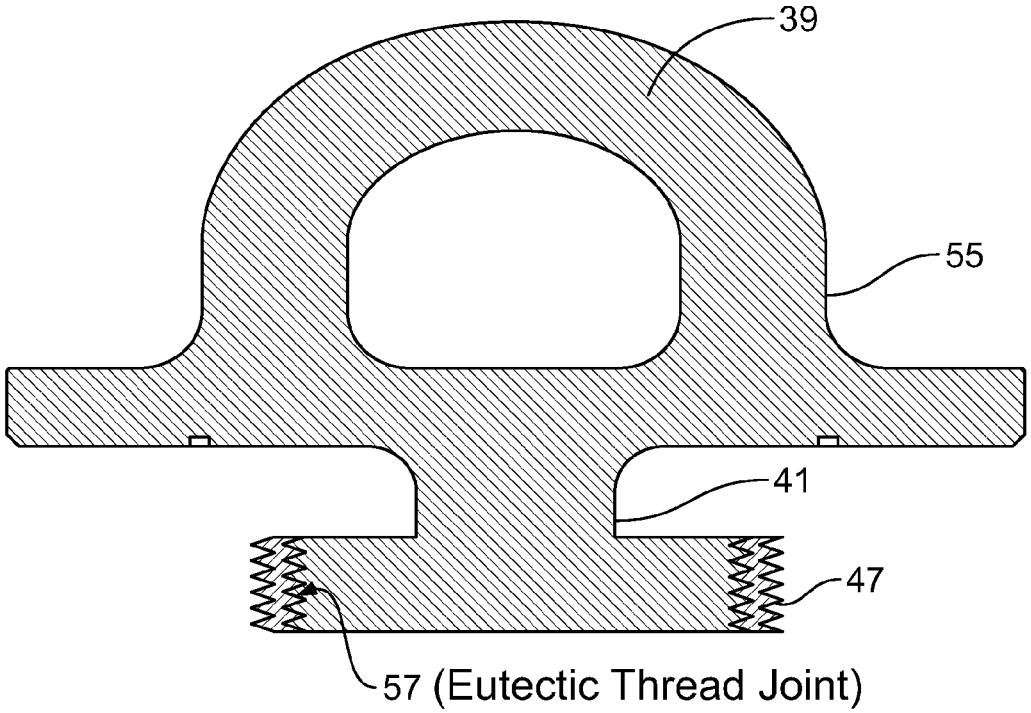
FIG. 5 is a side view of a lifting plug of the present invention with a threaded ring inserted thereon in threaded engagement, and which also is in sealing engagement with the lifting plug by virtue of a sealing solder of eutectic metal between external threads of the lifting plug and internal threads of the threaded ring.

As shown in FIG. 4, current lifting plug design 37 is maintained except the lifting plug 37 threaded section 43 has a threaded ring 47 added. Threaded ring 47 external thread 51 has the thread needed for threaded engagement with fuze cavity (not shown) in a munition. Threaded ring 47 internal thread 53 is a means of assembling same onto new lifting plug 55. When assembled, threaded ring 47 and new lifting plug 55 are "soldered" together with a eutectic solder (not shown), at a threaded joint 57 as illustrated in FIG. 5. The eutectic material flows as solder would, and provides a solid bond between new lifting plug 55 and threaded ring 47. According to the present invention, the new lifting plug 55 can detach itself upon reaching a elevated predetermined temperature.

Threaded ring 47 is designed to release a modified lifting plug 55 from threaded ring 47 when assembled in a fuze cavity of a munition. Release of lifting plug 55 is due to the "Hoop" pressure developed within the munition as its temperature rises. In this case, the energetics goes through a phase change from solid to liquid as the temperature rises, thus generating a volume differential or internal cavity pressure.

This internal cavity pressure increases at elevated temperatures and is taken advantage of because a eutectic material is used to solder the joint 57 between modified lifting plug 55 and threaded ring 47. This soldered joint 57 remains solid until the eutectic melts at a predetermined temperature above the operating temperature of the munition. That is, the eutectic changes to a liquid and then becomes a lubricant for the modified lifting plug 55 to be able to easily release from the threaded ring 47.

According to the present invention, new lifting plug 55 is just like the current lifting plug 37 except the threaded section is a smaller thread diameter to accept threaded ring 47. threaded ring 47 has two threads, external threads 51 and internal threads 53. External threads 51 match the current threads on the fuze cavity. Internal threads 53 facilitate attachment of threaded ring 47 to lifting plug 55, so that a thread gap is created to have the reflow of solder/eutectic go between the threads.

In a preferred embodiment, the thread joint 57 is larger than a normal thread gap to facilitate flow of eutectic. Preferably, the base metals of the new lifting plug 55 and ring 47 can be plated to improve the "wicking" action of the eutectic. Also, it is preferred to clean the threads in thread joint 57 to facilitate wicking of the eutectic. The internal thread can also have multiple pitch threads which are used to reduce the amount of turns of the lifting plug necessary for release.

As an example—a standard thread (any thread- 0.250-18 UNF) has a single pitch which may take 3 turns to release. The same thread with a 3 pitch thread would take 1 turn.

As the temperature rises in the interior cavity of the round, the internal pressures are exerted on lifting plug 55. When the eutectic in joint 57 melts or phase changes, then the internal pressure causes the lifting plug 55 to rotate off. Additionally, the threaded joint 57 itself can be made to reduce the number of turns via the use of multi-pitch threads. As an example, a normal thread configuration that takes four rotations of the lifting plug with a four pitch thread would only require one turn. This feature allows for a quick removal of the lifting plug under this dangerous scenario.

Although specific embodiments of the present invention have been disclosed herein, those having ordinary skill in the art will understand that changes can be made to the specific embodiments without departing from the spirit and scope of the invention. Thus, the scope of the invention is not to be restricted to the specific embodiments. Furthermore, it is intended that the appended claims cover any and all such applications, modifications, and embodiments within the scope of the present invention.

LIST OF DRAWING ELEMENTS

37: lifting plug
39: lifting ring
41: neck
43: threaded round portion
45: wax
47: threaded ring
51: external thread on threaded ring 47
53: internal thread on threaded ring 47

55: new lifting plug
57: threaded joint

What we claim is:

1. In an unfuzed munition having a fuze cavity with internal threads adapted to receive a threaded fuze, with a lifting plug comprising a lifting ring connected to a neck portion which in turn is connected to a round portion having external threads adapted for threaded engagement with the internal threads in the fuze cavity, the unfused munition further comprising:

a threaded ring threaded both externally and internally, with the external threads adapted to engage internal threads on the threaded fuze cavity, and the internal threads on the threaded ring adapted to facilitate attachment of the threaded ring to the lifting plug, wherein a thread gap is created that allows solder to flow between the internal threads of the ring and the external threads of the round portion of the lifting plug, the solder comprising one or more eutectic materials having a melting point below a predetermined critical temperature and pressure of cook-off gases generated by the munition.

2. The unfuzed munition of claim 1, wherein external threads on the lifting plug and internal threads on the threaded ring have a pitch which facilitates rotation of the lifting plug when cook-off gas temperatures have risen high enough to melt the eutectic solder of the thread engagement between the internal thread of the threaded ring and outer thread of the lifting plug and pressure build-up of cook-off gases is sufficiently high to cause rotation and separation of the lifting plug.

3. The unfuzed munition of claim 1, wherein the threaded ring is formed of carbon steel or stainless steel that would have mechanical properties superior to the base material of the lifting plug.

4. The unfuzed munition of claim 1, wherein the eutectic wets threaded surfaces of both the lifting plug and threaded ring and creates a environmental and pressure seal.

5. The unfuzed munition of claim 1, wherein a threaded lifting plug (as a new lifting plug assembly —with the eutectic) is in threaded engagement with a threaded ring which in turn is in threaded engagement with a fuze cavity of a munition.

6. The unfuzed munition of claim 5, wherein a threaded joint between the lifting plug and the threaded ring is soldered with one or more eutectic materials, which wets both threads of the joint.

7. The unfuzed munition of claim 6, wherein the eutectic solder is used to provide a pressure and mechanical seal between the lifting plug and the threaded ring joint.

8. The unfuzed munition of claim 7, wherein the eutectic solder seals the threaded joint and prevents release of cook-off gases until these gases reach a predetermined temperature.

9. The unfuzed munition of claim 1, wherein internal threads on the threaded ring and external threads on the lifting plug are coated with tin coating to facilitate wetting of the threaded joint by the eutectic.

10. The unfuzed munition of claim 1, wherein there is a sufficient clearance between the internal threads on the threaded ring and the external threads on the lifting plug to facilitate flow of eutectic material into the threaded joint when these threads are in locking and sealing engagement, and the threaded ring is formed from a material stronger than the material from which the neck of the lifting plug is formed, whereby to maintain a damage indicator feature of the lifting plug neck.

11. The unfuzed munition of claim 1, wherein the threaded ring is formed from a material stronger than the material from which the neck of the lifting plug is formed, whereby to maintain a damage indicator feature of the lifting plug neck.

12. A gas pressure discharge valve for an unfuzed munition having a fuze cavity with internal threads, said discharge valve comprising: a threaded ring having both external and internal threads, together with a lifting plug having a lifting ring connected to a neck portion which in turn is connected to a round portion having external threads, said external threads on the round portion adapted for threaded engagement with internal threads on the fuze cavity, internal threads on the threaded ring adapted to facilitate attachment of the threaded ring to the lifting plug, wherein a thread gap is created that allows solder to flow between the internal threads of the ring and the external threads of the round portion of the lifting plug, the solder comprising one or more eutectic materials having a melting point below a predetermined critical temperature and pressure of cook-off gases generated by the munition.

13. The unfuzed munition of claim 12, wherein external threads on the lifting plug and internal threads on the threaded ring have a pitch which facilitates rotation of the lifting plug when cook-off gas temperatures have risen high enough to melt the eutectic solder and pressure build-up of cook-off gases is sufficiently high to cause rotation and separation of the lifting plug from the munition.

14. The unfuzed munition of claim 12, wherein the threaded ring is formed of carbon steel, stainless steel, titanium, or other strong alloys thereof.

15. The unfuzed munition of claim 12, wherein the eutectic wets threaded surfaces of both the lifting plug and threaded ring.

16. The unfuzed munition of claim 15, wherein a threaded joint between the lifting plug and the threaded ring is soldered with one or more eutectic materials which wet both threads of the joint.

17. The unfuzed munition of claim 12, wherein the eutectic material is selected from the group consisting of bismuth, lead and tin.

18. The unfuzed munition of claim 17, wherein the eutectic solder seals the threaded joint and prevents release of cook-off gases until these gases reach a predetermined temperature, and internal threads on the threaded ring and external threads on the lifting plug are coated with a wetting agent to facilitate wetting of the threaded joint by the eutectic.

19. The unfuzed munition of claim 12, wherein there is a sufficient clearance between the internal threads on the threaded ring and the external threads on the lifting plug to facilitate flow of eutectic material into the threaded joint when these threads are in locking and sealing engagement, and the threaded ring is formed from a material stronger than the material from which the neck of the lifting plug is formed, whereby to maintain a damage indicator of the lifting plug neck.

20. A venting lifting plug for an unfuzed munition having a fuze cavity with internal threads, said venting lifting plug comprising: a threaded ring having both external and internal threads, together with a lifting plug having a lifting ring connected to a neck portion which in turn is connected to a round portion having external threads, said external threads on the round portion adapted for threaded engagement with internal threads on the fuze cavity, internal threads on the threaded ring adapted to facilitate attachment of the threaded ring to the lifting plug, wherein a thread gap is created that allows solder to flow between the internal threads of the ring and the external threads of the round portion of the lifting plug, the solder comprising one or more eutectic materials having a melting point below a predetermined critical temperature and pressure of cook-off gases generated by the munition, the external threads on the lifting plug and internal threads on the threaded ring have a pitch which facilitates rotation of the lifting plug when cook-off gas temperatures have risen high enough to melt the eutectic solder and pressure build-up of cook-off gases is sufficiently high to cause rotation and separation of the lifting plug from the munition, and the threaded ring is formed of carbon steel, and the eutectic wets threaded surfaces of both the lifting plug and threaded ring.

* * * * *